US008375905B2

(12) United States Patent
Sato et al.

(10) Patent No.: US 8,375,905 B2
(45) Date of Patent: Feb. 19, 2013

(54) ADJUSTABLE VALVE TRAIN FOR AN INTERNAL COMBUSTION ENGINE, AND ENGINE AND MOTORCYCLE INCORPORATING SAME

(75) Inventors: Toshiyuki Sato, Saitama (JP); Masaki Cho, Saitama (JP); Takahiro Imafuku, Saitama (JP); Natsue Ogawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 263 days.

(21) Appl. No.: 12/964,995

(22) Filed: Dec. 10, 2010

(65) Prior Publication Data

US 2011/0155083 A1 Jun. 30, 2011

(30) Foreign Application Priority Data

Dec. 25, 2009 (JP) ..... 2009-295155

(51) Int. Cl.
*F01L 1/34* (2006.01)

(52) U.S. Cl. ..... 123/90.16; 123/90.39; 123/90.44; 74/559; 74/569

(58) Field of Classification Search ..... 123/90.16, 123/90.39, 90.44; 74/559, 567, 569
See application file for complete search history.

(56) References Cited

U.S. PATENT DOCUMENTS 8,225,760 B2 * 7/2012 Sato et al. ..... 123/90.16

FOREIGN PATENT DOCUMENTS

JP 2008-208800 A 9/2008

* cited by examiner

*Primary Examiner* — Ching Chang
(74) *Attorney, Agent, or Firm* — Carrier Blackman & Associates, P.C.; William D. Blackman; Joseph P. Carrier

(57) ABSTRACT

A valve train for an internal combustion engine includes a camshaft, a valve-operating cam for operating an engine valve, and a link mechanism for swinging the valve-operating cam. The valve train also includes a holder member operable to turn around the camshaft, and a drive mechanism operable to turn the holder member for varying positions of the link mechanism. The drive mechanism includes a ball screw provided perpendicularly to the camshaft, a slider threadably engaged with the ball screw, an arm member swingably attached to the slider, and a connecting bolt having one end secured to an arm-connecting portion of the arm member, and the other end secured to the holder member. In such movable valve train for an internal combustion engine, the holder member and the drive mechanism are connected to each other with a small and lightweight configuration, requiring a minimal number of parts.

20 Claims, 12 Drawing Sheets

ADJUSTABLE VALVE TRAIN FOR AN INTERNAL COMBUSTION ENGINE, AND ENGINE AND MOTORCYCLE INCORPORATING SAME

CROSS-REFERENCE TO RELATED APPLICATIONS

The present invention claims priority under 35 USC 119 based on Japanese patent application No. 2009-295155, filed on Dec. 25, 2009. The entire subject matter of this priority document, including specification claims and drawings thereof, is incorporated by reference herein.

BACKGROUND OF THE INVENTION

1. Field of the Invention

The present invention relates to a movable valve train for an internal combustion engine, and to an engine and a motorcycle incorporating the same. More particularly, the present invention relates to a valve train having a link mechanism for swinging a valve-operating cam, and a drive mechanism operable to turn a holder member for varying positions of the link mechanism, and to an engine and a motorcycle including the same.

2. Description of the Background Art

There is known a movable valve train for an internal combustion engine. The movable valve train includes a drive cam rotated integrally with a camshaft supported by a cylinder head, and a valve-operating cam swingably supported by the camshaft to operate, i.e., to open and close engine valves. In addition, the movable valve train includes a link mechanism supported swingably around the camshaft for transmitting a valve driving force of the drive cam to the valve-operating cam for swing, a holder member connected to the link mechanism and turnable around the camshaft, and a drive mechanism for turning the holder member for varying positions of the support member of the link mechanism. The valve train configured as above can vary operating characteristics of the engine valve depending on the swing position of the swung link mechanism.

An example of such known movable valve train for an internal combustion engine is disclosed in the Japanese Patent Laid-open No. 2008-208800.

Incidentally, the movable valve train as described above is desired to connect the holder member connected to the link mechanism with the drive mechanism by a simple configuration and by using small number of parts.

In view of the above situations, the present invention has been made. Accordingly, one of the objects of the present invention is to provide a movable valve train for an internal combustion engine that can connect a holder member connected to a link mechanism with a drive mechanism by means of a small-sized lightweight configuration having a small number of parts.

SUMMARY OF THE INVENTION

In order to achieve the above objects, the present invention provides a variable valve train for an internal combustion engine. The variable valve train includes a camshaft rotatably supported by a cylinder head and rotated in synchronization with rotation of a crankshaft of the engine; a drive cam rotated integrally with the camshaft; a valve-operating cam swingably supported by the camshaft and opening/closing an engine valve; a link mechanism supported swingably around the camshaft to transmit valve drive force of the drive cam to the valve-operating cam for swinging the valve-operating cam; a holder member on which a support member of the link mechanism is provided and which can turn around the camshaft; and a drive mechanism turning the holder member to vary a position of the support member of the link mechanism. The operating characteristics of the opening and closing engine valve being capable of being varied depending on the swung position of the swung link mechanism.

The drive mechanism includes a ball screw provided perpendicularly to the camshaft, a slider threadably engaged with the ball screw, an arm member swingably attached to the slider, and a connecting member having one end secured to a swing portion-end of the arm member and the other end secured to the holder member.

With this configuration, the arm member is swingably attached to the slider and the swing portion-end of the arm member and the holder member are secured to each other through the connecting member. Therefore, the slider and the holder member can be connected to each other with a simple configuration. Thus, the holder member and the drive mechanism can be connected to each other by a small-sized and lightweight configuration having a small number of parts.

In the above configuration, the connecting member may be configured to have a first thread portion fastened to the holder member side and a second thread portion fastened to a connecting portion of the arm member.

In this case, the connecting member has the first and second thread portions, and is separately fastened on the holder member side and on the arm member side. Therefore, the connecting member can reliably be secured. This can reduce the assembly error between the holder member and the arm member.

The first thread portion may be configured to have a thread diameter smaller than that of the second thread portion.

In this case, the second thread portion, on the holder member side, requiring greater fastening force is increased in diameter and the first thread portion requiring smaller fastening force is reduced in diameter. This makes the fastening force appropriate, so that the assembly error can be reduced.

Further, a nut fastening the first thread portion may be configured to have the other end thereof extended to the connecting portion of the arm member, and to fasten the arm member to the connecting member in cooperation with a nut fastening the second thread portion.

In this case, the nut fastening the first thread portion is extended to the connecting portion of the arm member. In addition, the nut fastened to the second thread portion and the extended portion of the nut of the first thread portion can cooperatively fasten the arm member to the connecting member. Therefore, it is not necessary to use a spacer receiving the nut fastening the second thread portion. Thus, the number of component parts can be reduced.

An attachment portion for the slider and the arm member may be configured as a vertical groove. That is, the slider includes an attachment portion having a vertical groove formed therein. The arm member is assembled with the slider via said vertical groove.

In this case, the slider and the arm member are attached to each other using the vertical groove; therefore, the assembly of the arm member can be facilitated.

EFFECTS OF THE INVENTION

In the variable valve train of the internal combustion engine according to the present invention, the arm member is swingably attached to the slider and the swing portion-end of the arm member and the holder member are secured by means of the connecting member. Therefore, the slider and the holder member can be connected to each other with a simple configuration. Thus, the holder member and the drive mechanism can be connected to each other with a small-sized and lightweight configuration having a small number of parts.

The connecting member has the first and second thread portions and is separately fastened on the holder member side and on the arm member side. The connecting member can reliably be secured. This can reduce the assembly error between the holder member and the arm member.

The second thread portion, on the holder member side, requiring fastening force is increased in diameter and the first thread portion requiring smaller fastening force is reduced in diameter. This makes the fastening force appropriate, so that the assembly error can be reduced.

The nut fastened to the second thread portion and the extended portion of the nut of the first thread portion can cooperatively fasten the arm member to the connecting member. Therefore, it is not necessary to use a spacer receiving the nut fastening the second thread portion. Thus, the number of component parts can be reduced.

The slider and the arm member are attached to each other using the vertical groove; therefore, the assembly of the arm member can be facilitated.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

An embodiment of the present invention will now be described, with reference to the drawings. Throughout this description, relative terms like "upper", "lower", "above", "below", "front", "back", and the like are used in reference to a vantage point of an operator of the vehicle, seated on the driver's seat and facing forward. It should be understood that these terms are used for purposes of illustration, and are not intended to limit the invention.

Illustrative embodiments of the present invention will hereinafter be described with reference to the drawings. It may be noted that orientations such as the front, back or rear, left and right, and upside and downside in the explanation are described based on an operative orientation of a vehicle body.

Figure 1:
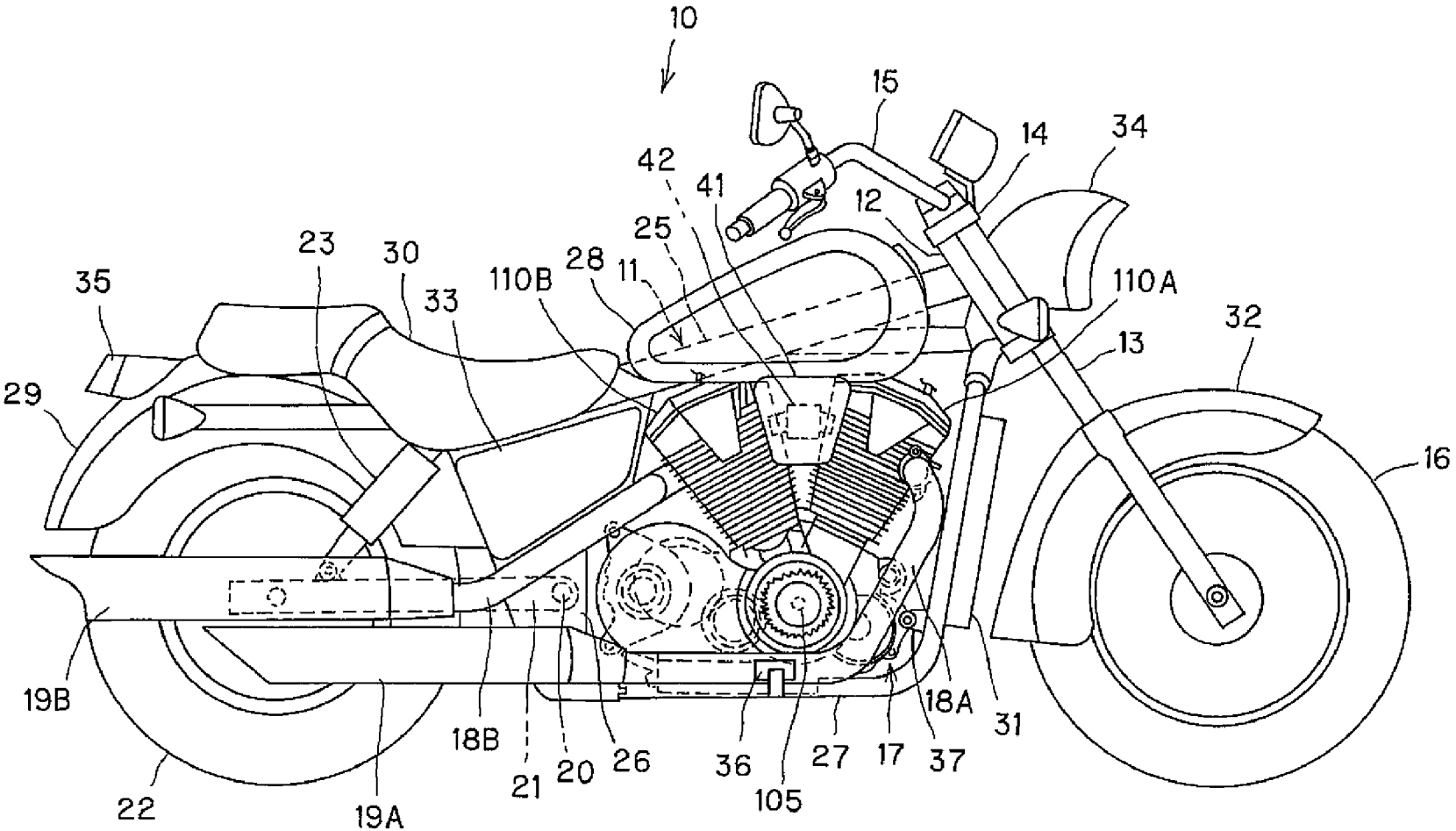
FIG. 1 is a right lateral view of a motorcycle to which a movable valve train of an internal combustion engine according to an embodiment of the present invention is applied.

FIG. 1 is a lateral view of a motorcycle employing a valve train of an internal combustion engine according to an embodiment of the present invention. The motorcycle 10 includes a body frame 11; a pair of left and right front forks 13 turnably supported by a head pipe 12 attached to a front end of the body frame 11; a steering handlebar 15 attached to a top bridge 14 supporting an upper end of the front forks 13; and a front wheel 16 rotatably supported by the front fork 13. The motorcycle 10 further includes an engine 17 as an internal combustion engine supported by the body frame 11; exhaust mufflers 19A and 19B connected via exhaust pipes 18A and 18B, respectively, to the engine 17; a rear swing arm 21 supported swingably up and down by a pivot 20 at a rear lower portion of the body frame 11; and a rear wheel 22 rotatably supported by a rear end of the rear swing arm 21. A rear cushion 23 is disposed between the rear swing arm 21 and the body frame 11.

The body frame 11 includes a main frame 25 extending rearward downward from the head pipe 12; a pair of left and right pivot plates (also called center frames) connected to a rear portion of the main frame 25; and a down tube 27 extending downward from the head pipe 12, then bending and extending, and connected to the pivot plate 26. A fuel tank 28 is supported by the main frame 25 so as to straddle it. A rear portion of the main frame 25 extends to above the rear wheel 22 and supports a rear fender 29. A seat 30 is supported between above the rear fender 29 and the fuel tank 28. As shown in FIG. 1, the motorcycle includes a radiator 31 supported by the down tube 27, a front fender 32, a side cover 33, a headlight 34, a taillight 35, and an occupant step 36.

The engine 17 is supported in a space surrounded by the main frame 25, the pivot plate 26 and the down tube 27. The engine 17 is a fore-aft V-type 2-cylinder water-cooled 4-cycle engine whose cylinders are banked forwardly and rearwardly in a V-shaped manner. The engine 17 is supported by the body frame 11 via a plurality of engine brackets 37 (only partially illustrated in FIG. 1) so that a crankshaft 105 may be oriented in a left-right horizontal direction relative to the vehicle body. Power of the engine 17 is transmitted to the rear wheel 22 via a drive shaft (not shown) disposed on the left side of the rear wheel 22.

The engine 17 is such that a V-angle (also called a bank angle) formed between a front bank 110A and a rear bank 110B both constituting corresponding cylinders is smaller (e.g. 52 degrees) than 90 degrees. The respective valve trains of the banks 110A, 110B are each configured as a 4-valve double over head camshaft (DOHC) type.

An air cleaner 41 and a throttle body 42 constituting an engine air intake system is disposed in a V-shaped space defined between the front bank 110A and the rear bank 110B. The throttle body 42 supplies air purified by the air cleaner 41 to the front bank 110A and the rear bank 110B. The exhaust pipes 18A and 18B, which constitute an engine exhaust system, are connected to the banks 110A and 110B, respectively. The exhaust pipes 18A and 18B pass on the right side of the vehicle body and connect with exhaust mufflers 19A and 19B, respectively, at their rear ends. Exhaust gas is discharged through the exhaust pipes 18A, 18B and corresponding exhaust mufflers 19A, 19B.

Figure 2:
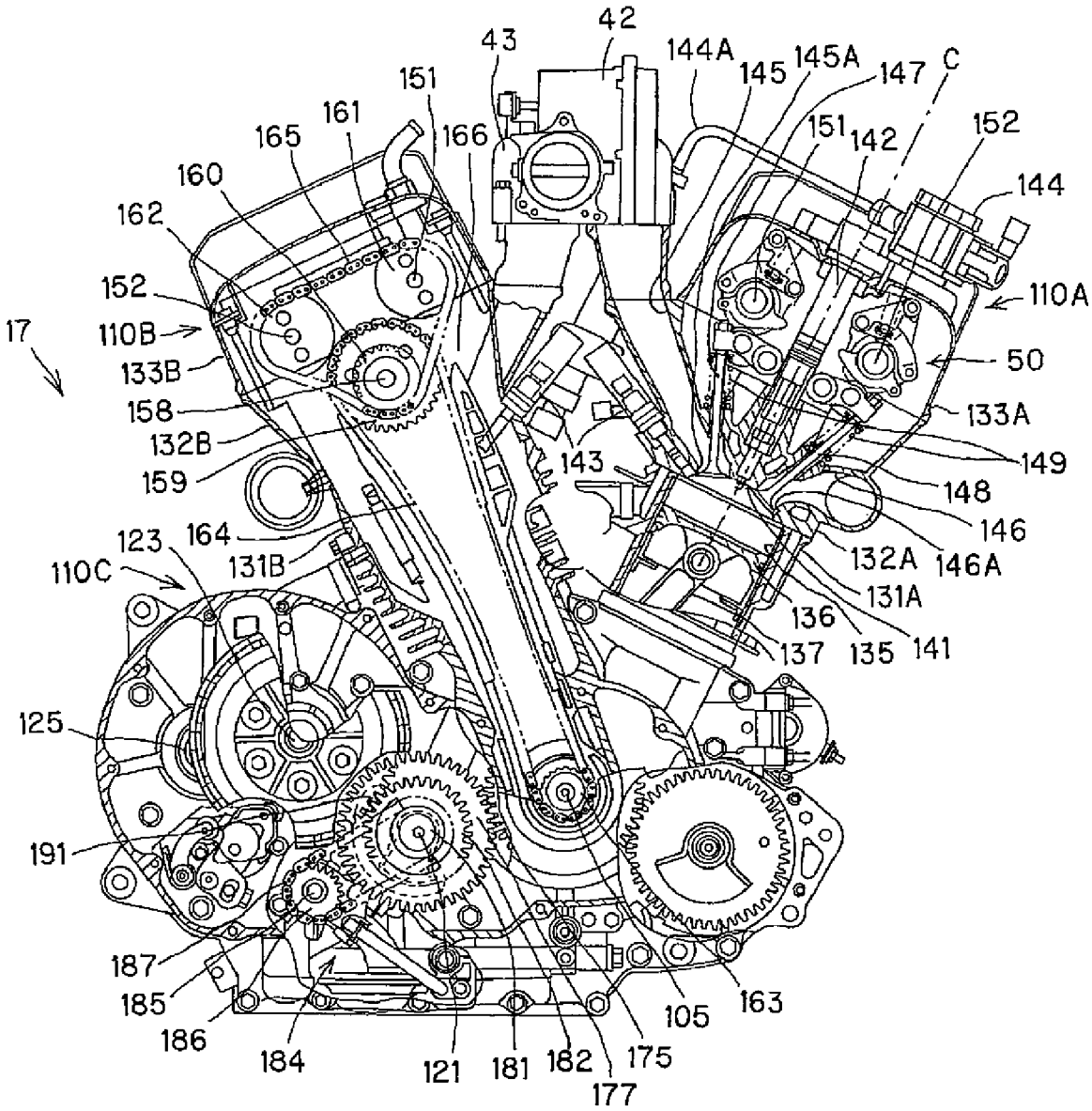
FIG. 2 illustrates an internal structure of the engine as viewed from the right side.
Figure 3:
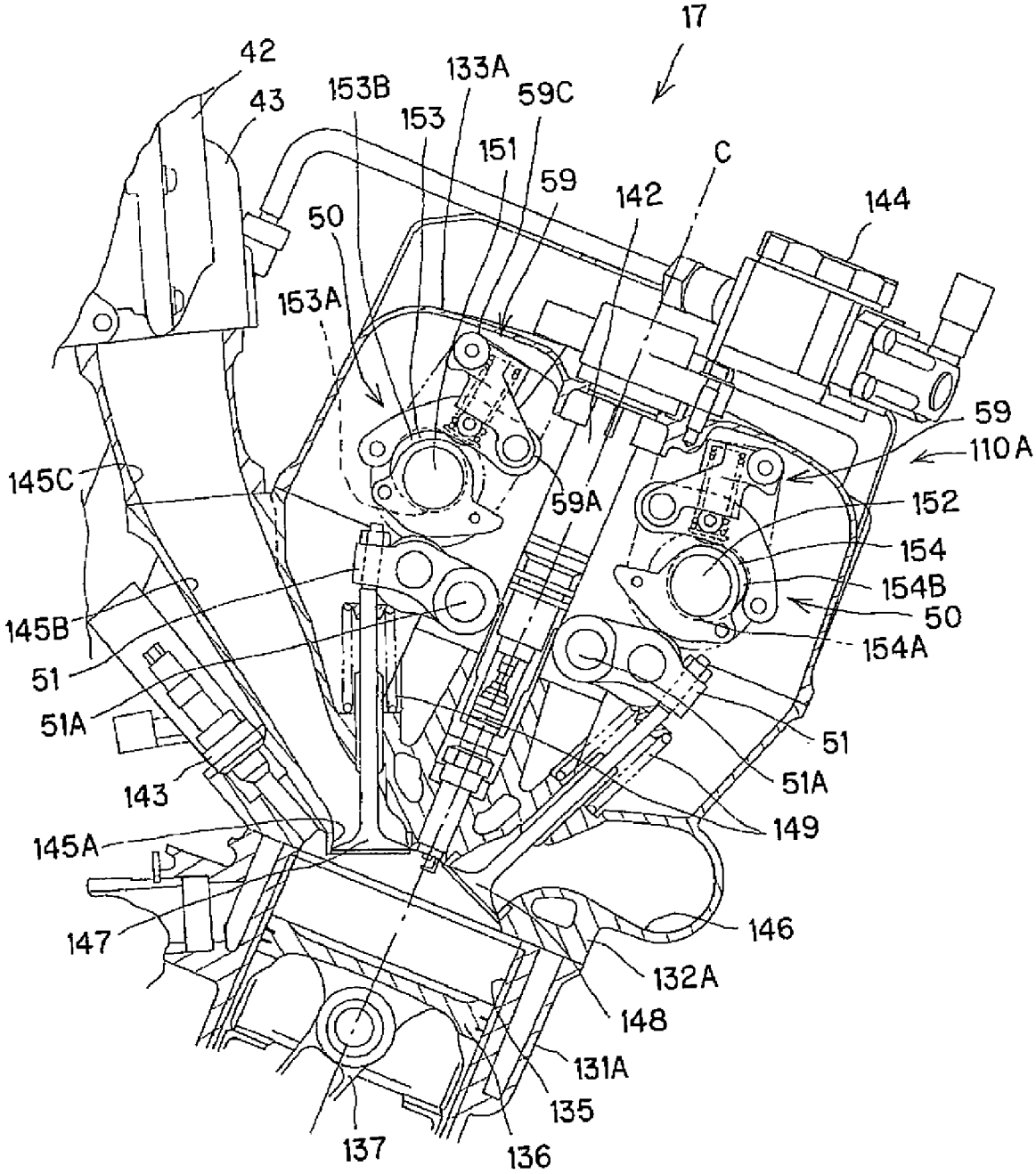
FIG. 3 illustrates an enlarged internal structure of a front bank of FIG. 2.

FIG. 2 is a lateral view of an internal configuration of the engine 17. FIG. 3 is an enlarged view of an internal configuration of the front bank 110A of FIG. 2.

Referring to FIG. 2, the front bank 110A and rear bank 110B of the engine 17 have the same configuration. FIG. 2 illustrates the vicinity of the piston in the front bank 110A and the vicinity of a cam chain in the rear bank 110B. In FIG. 2, reference symbol 121 denotes an intermediate shaft (a rear balancer shaft), 123 denotes a main shaft and 125 denotes a counter shaft. These shafts 121, 123, 125 including the crankshaft 105 are offset from one another in the back and forth, and up and down directions of the vehicle body so as to be arranged parallel to one another. A gear transmission mechanism configured to transmit the rotation of the crankshaft 105 to the intermediate shaft 121, the main shaft 123 and the counter shaft 125 in this order is disposed in a crankcase 110C supporting these shafts.

As illustrated in FIG. 2, a front cylinder block 131A and a rear cylinder block 131B are disposed on the upper surface of the crankcase 110C of the engine 17 so as to form a predetermined V-angle in the back and front of the vehicle body. A front cylinder head 132A and a rear cylinder head 132B are joined to the upper surfaces of the cylinder blocks 131A and 131B, respectively. Further, head covers 133A and 133B (cylinder head covers) are mounted to the upper surfaces of the cylinder heads 132A and 132B, respectively. In this way, the front bank 110A and the rear bank 110B are configured.

The cylinder blocks 131A, 131B are each formed with a cylinder bore 135, into which a piston 136 is slidably inserted. The piston 136 is connected to the crankshaft 105 via a connecting rod 137.

The cylinder heads 132A, 132B are each formed in a lower surface with a combustion recessed portion 141 constituting a top surface of a combustion chamber formed above the piston 136. An ignition plug 142 is disposed such that its distal end faces the combustion recessed portion 141. In addition, the ignition plug 142 is provided generally concentrically with a cylinder axis C.

The engine 17 is a direct injection engine which directly injects fuel into the combustion chamber from an injector 143 provided on the combustion recessed portion 141. The injector 143 is disposed to be inserted from a V-bank inner lateral surface of each of the cylinder heads 132A, 132B so that its distal end faces the associated combustion recessed portion 141. The injector 143 is mounted so as to have an angle relative to the cylinder axis C.

A fuel pump 144 is disposed above the cylinder head 133A. Fuel is supplied from the fuel pump 144 via the fuel pipe 144A to the injectors 143.

The cylinder heads 132A, 132B are each formed with intake ports 145 communicating with the corresponding combustion recessed portion 141 at a pair of opening portions 145A and with exhaust ports 146 communicating with the combustion recessed ports 141 at a pair of opening portions 146A. The intake port 145 is disposed between the cylinder axis C and the injector 143.

As illustrated in FIGS. 2 and 3, the intake port 145 includes a lower intake port 145B provided integrally with each of the cylinder heads 132A, 132B, and an upper intake port 145C provided separately from each of the cylinder heads 132A, 132B. The upper intake port 145C is attached to the lower intake port 145B so as to have an angle varied in a direction coming closer to each of the head covers 133A, 133B.

The intake ports 145 merge into an intake chamber 43, which is joined to the throttle body 42. The throttle body 42 employs throttle-by-wire (TBW) which varies the sectional area of the throttle valve by driving of an actuator. An exhaust port 146 of the cylinder head 132A is joined to the exhaust pipe 18A (FIG. 1). An exhaust port 146 of the cylinder head 132B is joined to the exhaust pipe 18B (FIG. 1).

A pair of intake valves 147 (engine valves) for opening and closing the opening portions 145A of the intake ports 145 and a pair of exhaust valves 148 (engine valves) for opening and closing the opening portions 146A of the intake ports 146 are arranged on each of the cylinder heads 132A, 132B. The intake valves 147 and the exhaust valves 148 are biased by corresponding valve springs 149, 149 in a direction of closing the corresponding ports.

The valve bodies 147, 148 are driven by a valve train 50 (a movable valve train) that can vary valve operating characteristics such as opening/closing timing, a lift amount, etc. of the engine valve. The valve train 50 includes intake side and exhaust side camshafts 151 and 152 rotatably supported by the cylinder heads 132A and 132B, respectively. The camshafts 151 and 152 are rotated in conjunction with the rotation of the crankshaft 105. The camshafts 151, 152 are rotated in a counterclockwise rotating direction in FIGS. 2 and 4.

The camshaft 151 is formed integrally with an intake cam 153 (a drive cam). The intake cam 153 includes a base circular portion 153A forming a circular cam surface and a cam lobe portion 153B forming a cam surface projecting from the base circular portion 153A toward the external circumferential side. The camshaft 152 is formed integrally with an exhaust cam 154 (a drive cam). The exhaust cam 154 includes a base circular portion 154A forming a circular cam surface and a cam lobe portion 154B projecting from the base circular portion 154A toward the external circumferential side to form a lobe-like cam surface.

As illustrated in FIG. 2, the intermediate shaft 158 is rotatably supported on one end side in the width direction of each of the cylinder heads 132A, 132B and intermediate sprockets 159, 160 are secured to the intermediate shaft 158. A driven sprocket 161 is secured to one end side of the camshaft 151. A driven sprocket 162 is secured to one end side of the camshaft 152. A drive sprocket 163 is secured to both end sides of the crankshaft 105. A first cam chain 164 is wound between the sprockets 159, 163 and a second cam chain 165 is wound between the sprockets 160 to 162. The sprockets 159 to 163 and the cam chains 164, 165 are housed in a cam chain chamber 166 formed on one end side of each of the banks 110A, 110B.

A reduction ratio from the drive sprocket 163 to the driven sprockets 161, 162 is set to 2. If the crankshaft 105 is rotated, the drive sprocket 163 is rotated integrally therewith to rotate the driven sprockets 161, 162 via the cam chains 164, 165 at a rotation speed half that of the crankshaft 105. In this way, the intake valves 147 and the exhaust valves 148 open and close the intake ports 145 and the exhaust ports 146, respectively, in accordance with the cam profiles of the camshafts 151, 152 rotated integrally with the driven sprockets 161, 162.

A generator (not shown) is provided at a left end portion of the crankshaft 105. A drive gear (also referred as the crank side drive gear) 175 is secured to the right end of the crankshaft 105 and inside (on the left side of the vehicle body) the right drive sprocket 163 mentioned above. The crank side drive gear 175 meshes with a driven gear (also referred as the intermediate side driven gear) 177 provided on the intermediate shaft 121. In addition, the crank side drive gear 175 transmits the rotation of the crankshaft 105 to the intermediate shaft 121 at a constant-speed to rotate it at the same speed as and reversely to that of the crankshaft 105.

The intermediate shaft 121 is rotatably supported rearward of and below the crankshaft 105 and forward of and below the main shaft 123.

An oil pump drive sprocket 181, the intermediate side driven gear 177 and a drive gear (also referred as the intermediate side drive gear) smaller in diameter than the driven gear 177 are mounted in this order to the right end portion of the intermediate shaft 121.

The oil pump drive sprocket 181 is adapted to transmit the rotational force of the intermediate shaft 121 via a transmission chain 187 to a driven sprocket 186 to drive a oil pump 184. The driven sprocket 186 is secured to a drive shaft 185 of the oil pump 184 disposed rearward of the intermediate shaft 121 and below the main shaft 123.

The intermediate side drive gear 182 meshes with a driven gear (also referred as the main side driven gear) 191 provided relatively rotatably on the main shaft 123 to reduce the rotation speed of the intermediate shaft 121 and transmit it to the main shaft 123 via a clutch mechanism (not shown). In other words, the reduction ratio from the crankshaft 105 to the main shaft 123, i.e., a primary reduction ratio of the engine 17 is set based on the reduction ratio between the intermediate side drive gear 182 and the main side driven gear 191.

The main shaft 123 is rotatably supported rearwardly of and above the crankshaft 105 and the counter shaft 125 is rotatably supported generally rearward of the main shaft 123. Speed-change gear groups not shown are arranged to straddle the main shaft 123 and the counter shaft 125 to constitute a transmission device.

A drive shaft (not shown) extending in the back and forth direction of the vehicle body is coupled to a left end portion of the counter shaft 125. Thus, the rotation of the counter shaft 125 is transmitted to the drive shaft.

Figure 4:
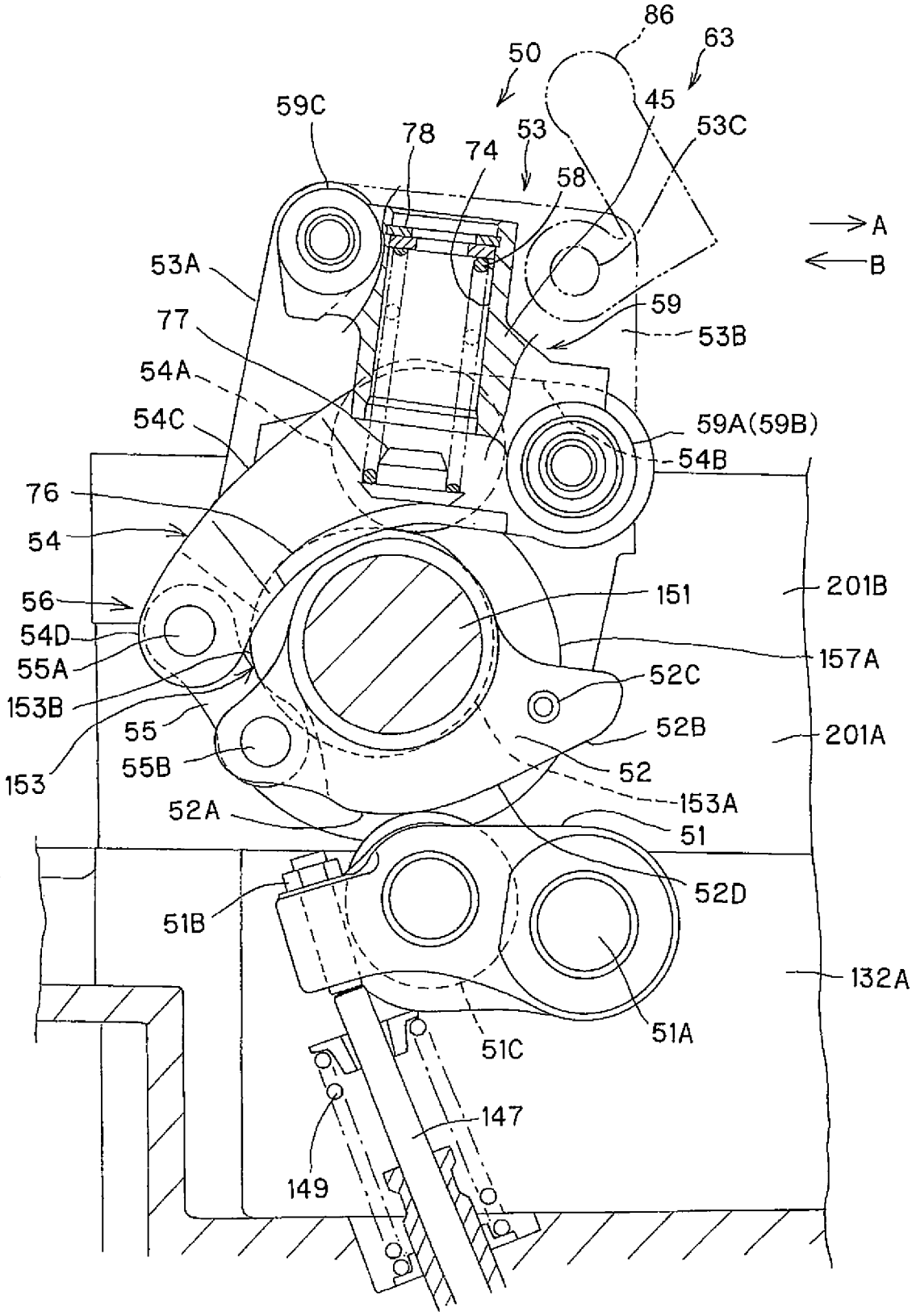
FIG. 4 is a partial broken-out lateral view illustrating the valve train.
Figure 5:
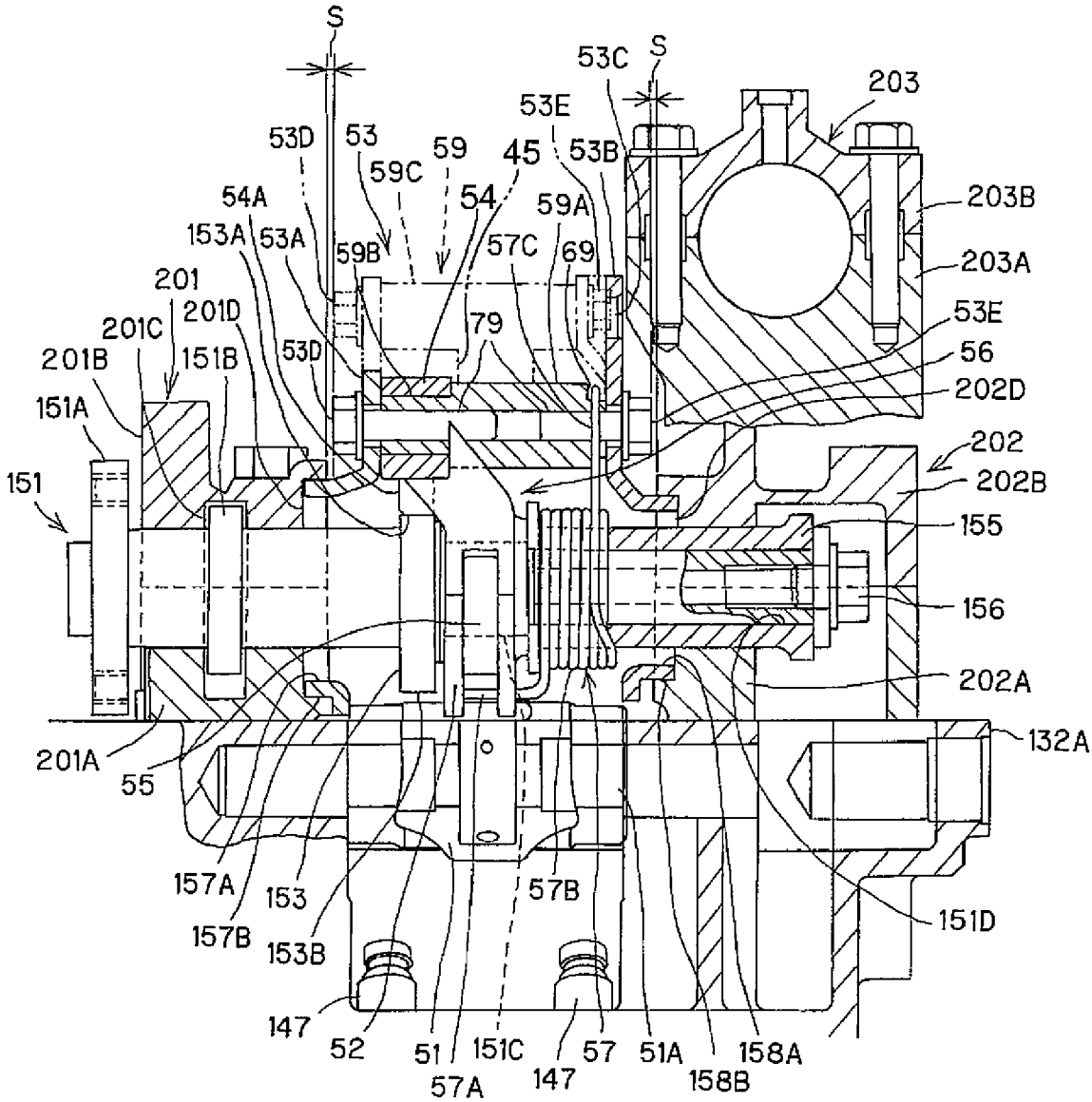
FIG. 5 is a longitudinal cross-sectional view of a valve train of the front bank.

FIG. 4 is a partially broken-out lateral view of the valve train 50 and FIG. 5 is a longitudinal cross-sectional view of the valve train 50 of the front bank 110A as viewed from the rear side.

As illustrated in FIG. 3, the valve trains 50 are provided on the intake side and on the exhaust side symmetrically to the cylinder axis C and independently of each other. Since the respective valve trains 50 of the front bank 110A and the rear bank 110B have generally the same configuration, the valve train 50 on the intake side of the front bank 110A is described in the present embodiment.

Referring to FIGS. 4 and 5, the valve train 50 includes the camshaft 151 (the camshaft 152 on the exhaust side); the intake cam 153 (the intake cam 154 on the exhaust side) rotated integrally with the camshaft 151; and a rocker arm 51 opening and closing the intake valves 147 (the exhaust valves 148 on the exhaust side). The valve train 50 further includes a valve-operating cam 52 relatively rotatably supported by the camshaft 151 and opening and closing the intake valves 147 via the rocker arm 51; a holder member 53 swingable around the camshaft 151; a link mechanism 56 swingably supported by the holder member 53 to transmit the valve driving force of the intake cam 153 to the valve-operating cam 52 for swing; and a drive mechanism 60 (see FIG. 6) turning the holder member 53. The link mechanism 56 includes a sub-rocker arm 54 connected to the holder member 53 and a connecting link 55 swingably connecting the sub-rocker arm 54 with the valve-operating cam 52.

The rocker arm 51 is formed wide so that one rocker arm 51 opens and closes the pair of intake valves 147. The rocker arm 51 is swingably supported at one end by a rocker arm pivot 51A secured to the cylinder head 132A. Screw-type adjustment portions 51B are provided at the other end of the rocker arm 51 so as to come into abutment against the upper ends of the intake valves 147. A roller 51C is rotatably supported by the central portion of the rocker arm 51 so as to come into contact with the valve-operating cam 52.

Referring to FIG. 5, the camshaft 151 has on one end side a sprocket securing portion 151A to which the driven sprocket 161 (FIG. 2) is secured. In addition, in order from the sprocket securing portion 151A, a positioning portion 151B, the intake cam 153, a valve-operating cam supporting portion 151C and a collar fitting portion 151D are provided on the camshaft 151. The positioning portion 151B is formed circular in cross-section to project from the outer circumference of the camshaft 151.

The valve-operating cam supporting portion 151C swingably supports the valve-operating cam 52. The collar fitting portion 151D is formed to have a diameter smaller than that of the valve-operating cam supporting portion 151C. A camshaft collar 155 functioning as a bearing of the camshaft 151 is fitted to the collar fitting portion 151D. The camshaft collar 155 is pressed against the valve-operating cam 52 by a securing bolt 156 fastened to the other end side of the camshaft 151.

The camshaft 151 is rotatably supported at both ends by camshaft supporting portions 201, 202. Specifically, the camshaft support portions 201, 202 are configured such that caps 201B and 202B each having a support portion semicircular in cross-section are secured to head side support portions 201A and 202A, respectively, semi-circular in cross-section, formed on the upper portion of the cylinder head 132A.

The camshaft support portion 201 provided on the side of the positioning portion 151B is formed with a groove 201C formed to conform to the shape of the positioning portion 151B. The position of the positioning portion 151B is restricted by the groove 201C to axially position the camshaft 151.

Holder support portions 201D and 202D supporting the holder member 53 are provided on the surfaces of the camshaft support portions 201 and 202, respectively, on the side of the intake cam 153.

The valve-operating cam 52 is pivotally supported by the valve-operating cam support portion 151C provided at the intermediate portion of the camshaft 151. As illustrated in FIG. 4, the valve-operating cam 52 is formed with a base circular portion 52A adapted to maintain the intake valves 147 in a closed state and with a cam lobe portion 52B adapted to press down the intake valve 147 to open it. The cam lobe portion 52B is formed with a through-hole 52C. A valve-operating cam return spring 57 (see FIG. 5) is attached at one end 57A to the through-hole 52C. The valve-operating cam returning spring 57 is adapted to bias the valve-operating cam 52 in a direction where the cam lobe portion 52B is moved away from the roller 51C of the rocker arm 51, i.e., in a direction of closing the intake valves 147.

As illustrated in FIG. 5, the valve-operating cam return spring 57 is a torsion coil spring and has a coil portion 57B wound around the camshaft 151 and attached to the holder member 53 at the other end. The coil portion 57B is formed axially lengthwise to go over a groove portion 69. The other end 57C is wound toward the one end 57A so as to overlap the coil portion 57B. While ensuring the number of windings of the valve-operating cam return spring 57, this can dispose the valve-operating cam return spring 57 in an axially compact manner.

The holder member 53 includes first and second plates 53A, 53B holding the intake cam 153 and the valve-operating cam 52 and spaced at a predetermined interval from each other in the axial direction of the camshaft 151; and a sub-rocker arm holder 59 connecting together the first and second plates 53A, 53B in the axial direction of the camshaft 151. The first plate 53A is disposed at one end side of the camshaft 151 to which the driven sprocket 161 is secured. The second plate 53B is disposed at the other end side of the camshaft 151.

The sub-rocker arm holder 59 is configured to include shaft portions 59A and 59C parallel to the camshaft 151 and a joining portion 45 integrally joining the shaft portion 59A and the shaft portion 59C together. The joining portion 45 is formed with a cylindrical receiving portion 74, in which a sub-rocker arm return spring 58 (also referred as a return spring) biasing the sub-rocker arm 54 toward the intake cam 153 is received.

The shaft portion 59A is formed at an end close to the first plate 53A with a sub-rocker arm support portion 59B (the support member) connected to one end of the sub-rocker arm 54. The sub-rocker arm portion 59B is a shaft formed smaller in diameter than the shaft portion 59A.

The first and second plates 53A, 53B and the sub-rocker arm holder 59 are secured to each other by means of a pair of bolts 53D and a pair of bolts 53E. The pair of bolts 53D fastens the first plate 53A and the sub-rocker arm holder 59 together from the external surface side of the first plate 53A. The pair of bolts 53E fastens the second plate 53B and the sub-rocker arm holder 59 together from the external surface side of the second plate 53B. An internal thread portion 79 to be threadably engaged with the bolt 53D is formed on the shaft portion 59A. An internal thread portion 79 to be threadably engaged with the bolt 53E is formed on the shaft portion 59C.

The second plate 53B is formed with a bolt hole 53C connected to the drive mechanism 60.

The first and second plates 53A and 53B have shaft holes 157A and 158A, respectively, adapted to receive the camshaft 151 passed therethrough as shown in FIG. 5. The respective circumferential edge portions of the shaft holes 157A and 158A serve as circular projecting portions 157B and 158B projecting toward the holder support portions 201D and 202D of the camshaft support portions 201 and 202, respectively. The holder member 53 is supported by the projecting portions 157B and 158B fitted respectively to the holder support portions 201D and 202D, so as to be swingable around the camshaft 151. In addition, the circular projecting portions 157B, 158B are coaxially assembled to the camshaft 151.

A clearance S is axially defined between an end of the cap 201B and the bolt 53D, and also between the cap 202B and the bolt 53E. The clearance S is set at such a size that when the cap 201B is assembled to the head side support portion 201A from upside, it is prevented from coming into contact with the bolt 53D, and that when the cap 202B is assembled to the head side support portion 202A from upside, it is prevented from coming into contact with the bolt 53E. In this way, since during assembly work the bolts 53D, 53E do not lie in the way, assembly performance is satisfactory.

The sub-rocker arm 54, along with the intake cam 153 and the valve-operating cam 52, is disposed between the first and second plates 53A, 53B. In addition, the sub-rocker arm 54 is supported at one end by the sub-rocker arm support portion 59B of the sub-rocker arm holder 59 so as to be swingable around the sub-rocker arm support portion 59B. A roller 54A is rotatably supported by the central portion of the sub-rocker arm 54 so as to come into contact with the intake cam 153 and press the base circular portion 153A and the cam lobe portion 153B.

One end of the connecting link 55 is connected to the other end portion of the sub-rocker arm 54 via a pin 55A swingably supporting the connecting link 55. In addition, the other end of the connecting link 55 is connected to the valve-operating cam 52 via a pin 55B swingably supporting the valve-operating cam 52.

The sub-rocker arm 54 is biased by the return spring 58. Thus, the roller 54A of the sub-rocker arm 54 is constantly pressed against the intake cam 153.

The sub-rocker arm 54 includes a holder connecting portion 54B joined to the sub-rocker arm support portion 59B and extending perpendicularly to the camshaft 151; an eccentric portion 54C curved downward from the holder connecting portion 54B along the outer diameter of the camshaft 151; and a link portion 54D connected to the valve-operating cam 52 via the connecting link 55.

The eccentric portion 54C is eccentric in the axial direction of the camshaft 151 from the side of the first plate 53A toward the second plate 53B so as to avoid the intake cam 153. In addition, the eccentric portion 54C is formed on a lateral surface with a plate-like stepped portion 76 protruding in the axial direction of the camshaft 151. The stepped portion 76 is provided to curve along the lower edge portion of the sub-rocker arm 54. The lower end of the return spring 58 is received by the stepped portion 76 via a spring washer 77 (FIG. 4). The upper end of the return spring 58 is received by a circlip 78 engaging with a receiving portion 74.

The link portion 54D is provided to merge with the end of the eccentric portion 54C and is joined to the valve-operating cam 52 via the connecting link 55. As described above, since the eccentric portion 54C is eccentric, the sub-rocker arm 54 connects together the intake cam 153 and the valve-operating cam 52 located at respective positions different from each other in the axial direction of the camshaft 151.

A description is next given of the operation of the valve train 50.

Referring to FIG. 4, in the valve train 50 configured as described above, when the camshaft 151 is rotated counterclockwise in the figure, the intake cam 153 rotated integrally with the camshaft 151 allows the cam lobe portion 153B to lift the sub-rocker arm 54 via the roller 54A and swing around the shaft portion 59A. Along with this, the valve-operating cam 52 is rotated clockwise in FIG. 4 around the camshaft 151 via the connecting link 55. The rotation of the valve-operating cam 52 allows the cam lobe portion 52B to press the rocker arm 51 via the roller 51C and press down the intake valves 147 via the roller 51C, opening the intake valves 147.

In the state where the camshaft 151 is further rotated to bring the base circular portion 153A of the intake cam 153 into abutment against the roller 54A, the sub-rocker arm 54 is pressed down by the return spring 58. At the same time, the valve-operating cam 52 is rotated counterclockwise, in FIG. 4, by the valve-operating cam return spring 57 to bring the base circular portion 52A into abutment against the roller 51C. In this way, the intake valves 147 are pressed up and closed by the valve spring 149 (FIG. 2).

As illustrated in FIG. 4, the valve train 50 is such that the drive mechanism connecting member 63 is connected to the holder member 53. The drive mechanism connecting member 63 is connected to the drive mechanism 60 (FIG. 6) and the holder member 53 is swung in an arrow-A direction and in an arrow-B direction by driving the drive mechanism 60.

If the holder member 53 is swung in the arrow-A direction, the sub-rocker arm support portion 59B, along with the holder member 53, is positionally varied so that the link mechanism 56 is swung around the axial center of the camshaft 151 clockwise, the roller 54A is swung clockwise, and the valve-operating cam 52 is swung clockwise. On the other hand, if the holder member 53 is shifted in the arrow-B direction, the link mechanism 56, along with the holder member 53, is swung around the axial center of the camshaft 151 counterclockwise, the roller 54A is swung counterclockwise, and the valve-operating cam 52 is swung counterclockwise.

In this manner, the valve train 50 is configured so that the position of the roller 54A and the initial position of the swing of the valve-operating cam 52 are varied to make it possible to control valve operating characteristics of the intake valve 147 and of the exhaust valve 148, i.e., opening/closing timing, opening/closing periods and an lift amount of the intake valve 147 and of the exhaust valve 148.

The initial position of swing of the valve-operating cam 52 here means a swing position of the valve-operating cam 52 in the state where the roller 54A is in abutment against the base circular portion 153A of the intake cam 153 and the sub-rocker arm 54 is not lifted by the cam lobe portion 153B.

For example, if the intake side holder member 53 is further swung in the arrow-A direction (clockwise in FIG. 4), the roller 54A and the valve-operating cam 52 are rotated clockwise and the cam lobe portion 52B comes close to the roller 51C. In this state, if the camshaft 151 is rotated, the lift start timing of the roller 54A by the cam lobe portion 153B is advanced and period where the cam lobe portion 52B depresses the roller 51C and a depressing amount are increased. This advances the opening timing of the intake valve 147 and increases the opening period and lift amount of the intake valve 147.

Figure 6:
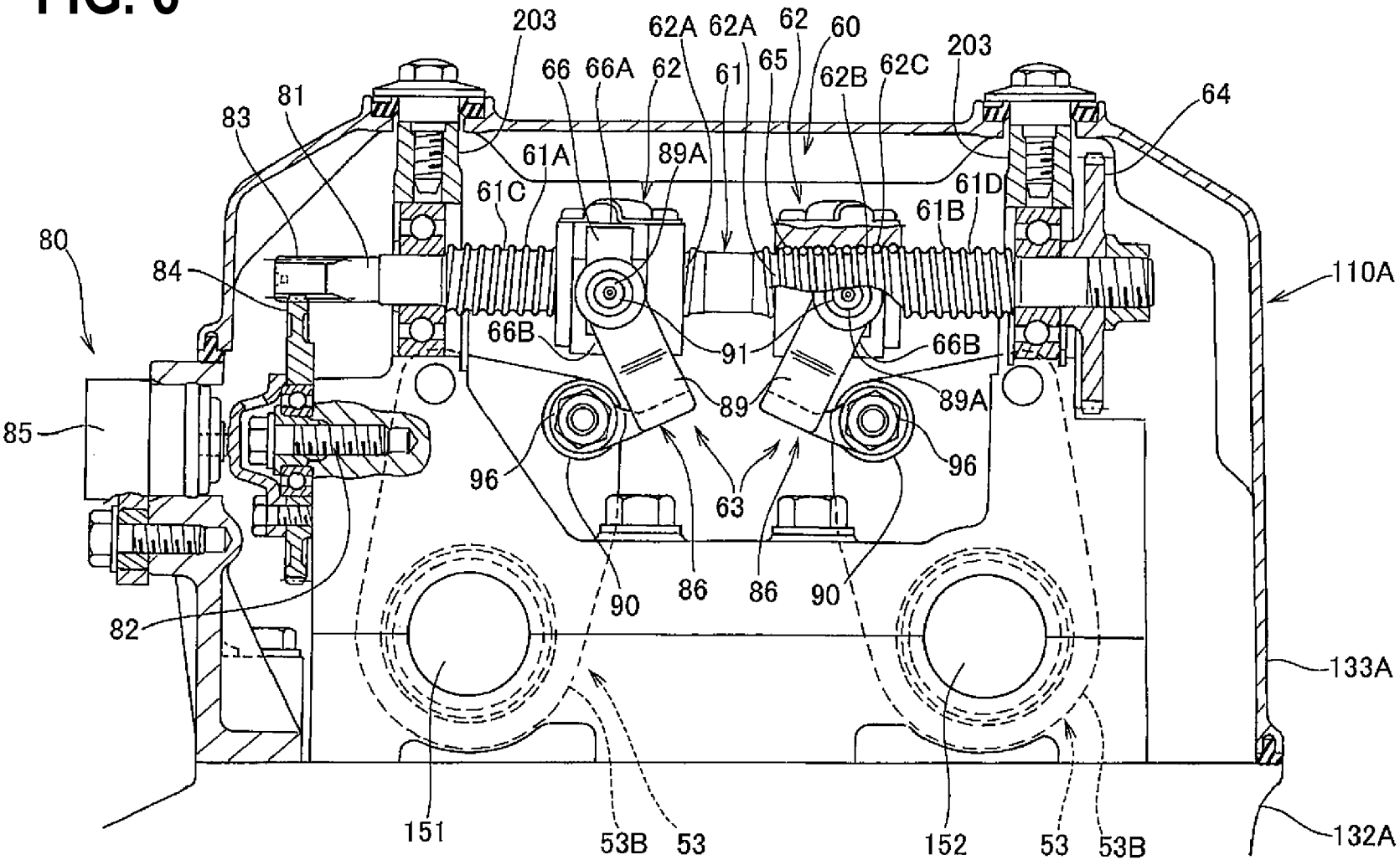
FIG. 6 is a longitudinal cross-sectional view of a drive mechanism as viewed from the lateral surface side.
Figure 7:
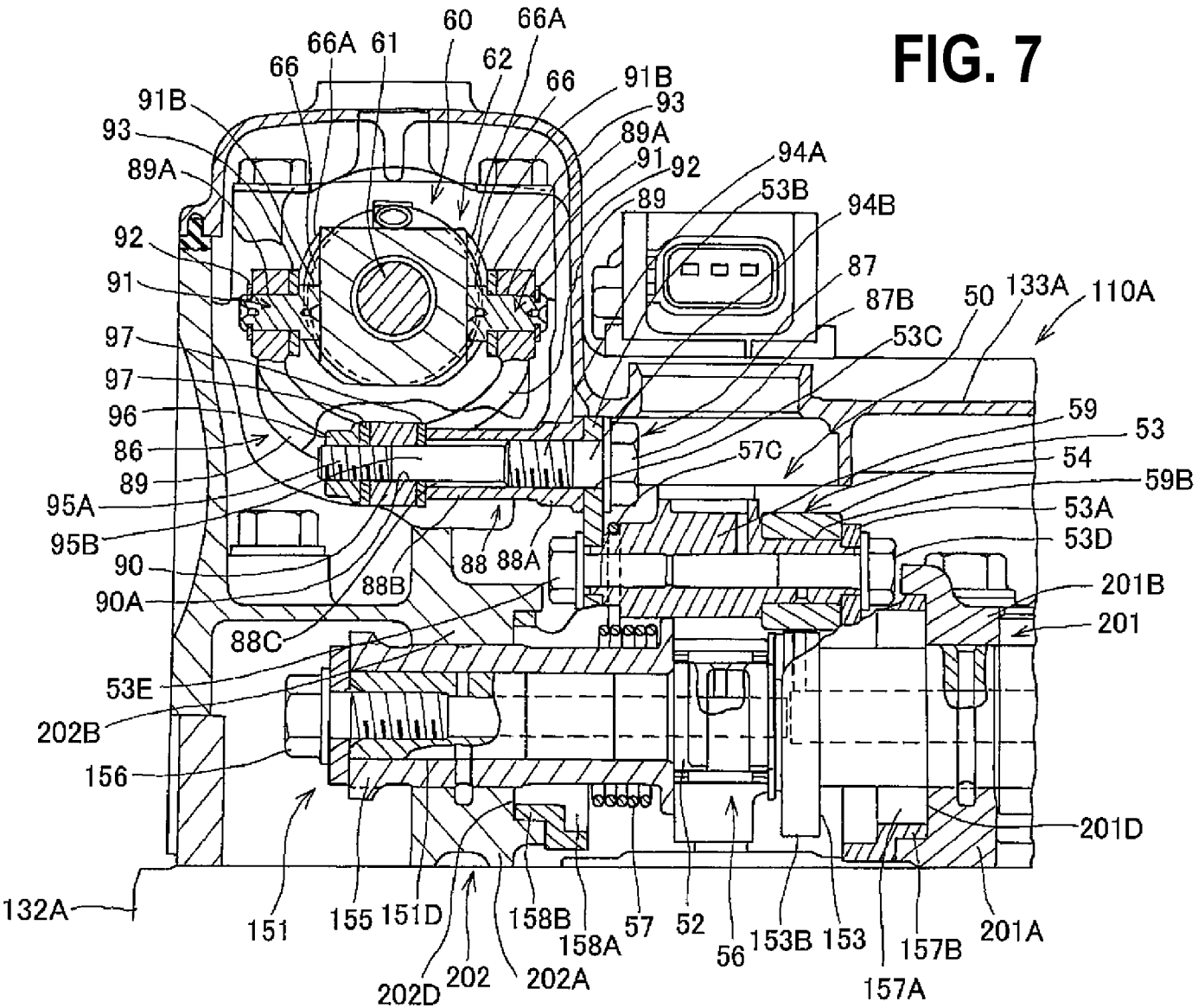
FIG. 7 is a longitudinal cross-sectional view of the drive mechanism as viewed from the front side.
Figure 8:
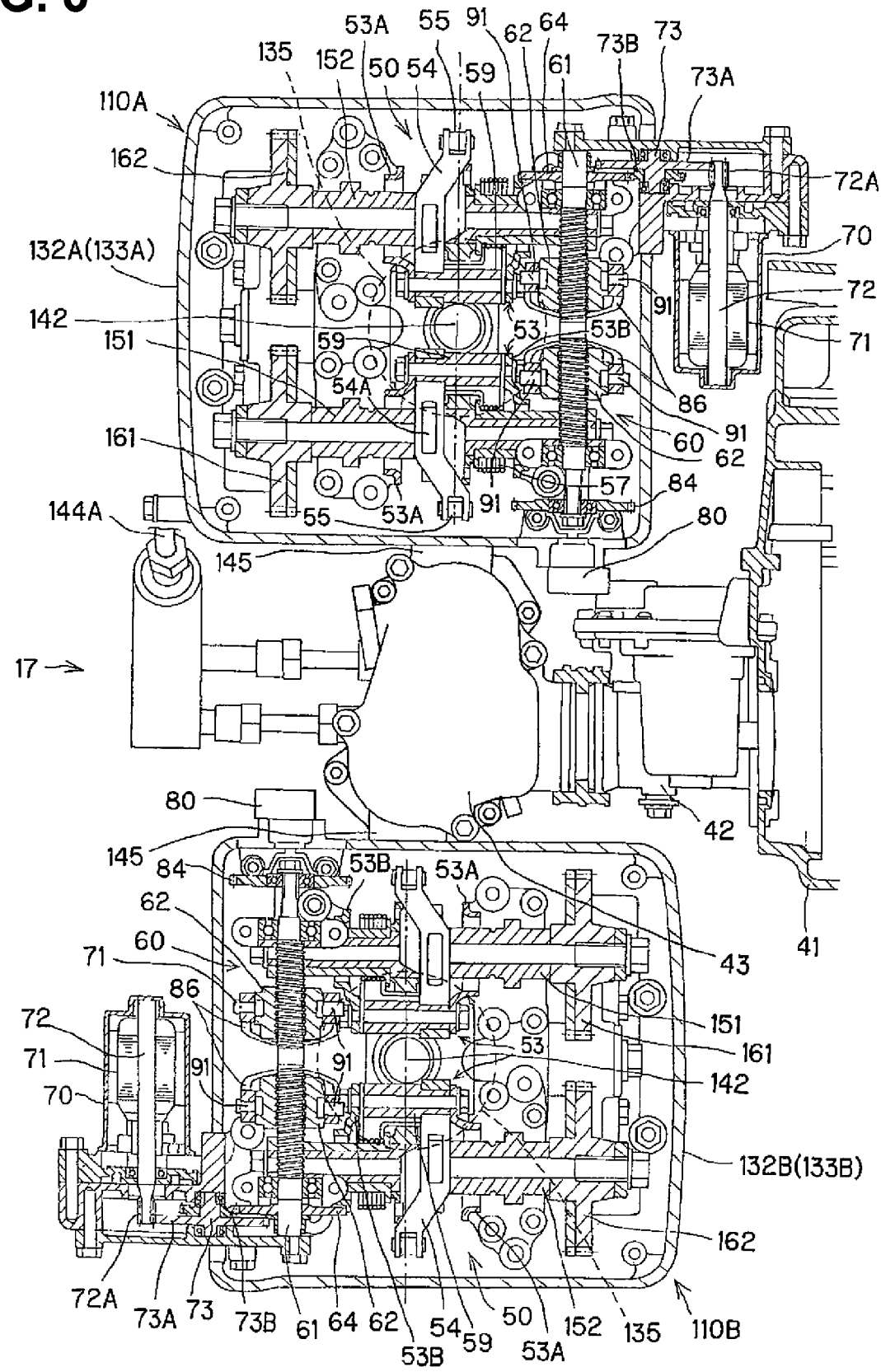
FIG. 8 is a transverse cross-sectional view of the engine as viewed from above.

FIG. 6 is a longitudinal cross-sectional view of the drive mechanism 60 as viewed from the lateral side. FIG. 7 is a longitudinal cross-sectional view of the drive mechanism 60 as viewed from the front side. FIG. 8 is a transverse cross-sectional view of the engine 17 as viewed from above. Further, FIG. 8 illustrates the front and rear banks 110A, 110B as viewed from above the engine 17 along the cylinder axis C (FIG. 2).

Referring to FIG. 6, the drive mechanism 60 is connected to the holder members 53 via the corresponding drive mechanism connecting members 63. The drive mechanism 60 includes a rod-like ball screw 61 disposed to straddle the camshafts 151, 152; two respective sliders 62 installed on the intake side and the exhaust side so as to be axially movable on the ball screw 61; an electric actuator 70 adapted to turn the ball screw 61 (FIG. 8); and the drive mechanism connecting members 63. The drive mechanism connecting member 63 is installed between the slider 62 and the holder member 53.

A gear 64 is secured to one end portion of the ball screw 61 on the side of the camshaft 152. The electric actuator 70 is connected to the gear 64 via a gear ring train. The electric actuator 70 is controlled by an electronic control unit (ECU) of the vehicle. The ECU drives the electric actuator 70 to swing the holder members 53 via the ball screw 61 and the drive mechanism connecting members 63. Thus, the opening/closing operating characteristics of each of the intake valve 147 and the exhaust valve 148 are controlled according to the operating conditions of the engine 17.

The electric actuator 70 includes an electric motor 71; a drive shaft 72 of the electric motor 71; and an intermediate shaft 73 adapted to receive the drive force of the electric motor 71 supplied from the drive shaft 72. The electric motor 71 is disposed on a vehicle-widthwise external side surface on the upper portion of the cylinder head 132A in such a manner that the drive shaft 72 is substantially parallel to the ball screw 61.

The drive shaft 72 is formed with a drive gear 72A. A first intermediate gear 73A meshing with the drive gear 72A and a second intermediate gear 73B meshing with the gear 64 provided on the ball screw 61 are secured to the intermediate shaft 73.

The ball screw 61 is disposed perpendicularly to the camshafts 151, 152 and on the side opposite the other end side of the camshafts 151, 152, i.e., opposite the side where driven sprockets 161, 162 are secured. As described above, the ball screw 61 does not extend in the vertical direction of the engine 17 but is disposed to lie and straddle the camshafts 151, 152. Therefore, the height of the engine 17 can be suppressed to a low level.

The ball screw 61 is rotatably supported at both ends by ball screw support portions 203. As illustrated in FIG. 5, the ball screw support portion 203 is configured such that a cap 203B having a support portion semicircular in cross-section is secured to a camshaft side support portion 203A formed on the upper portion of the camshaft support portion 202.

As illustrated in FIG. 6, the ball screw 61 is formed on the outer circumferential surface with a helical screw thread 61A and a helical thread groove 61C on the intake side and with a helical screw thread 61B and a helical thread groove 61D on the exhaust side. The thread 61A and thread groove 61C, and the thread 61B and thread groove 61D are set reversely to each other in a screw winding direction between the intake side and the exhaust side. The ball screw 61 is turned to shift the sliders 62 in a direction reverse to each other, which swing the intake side and exhaust side holder members 53.

The slider 62 is formed like a block and has a through-hole 62A adapted to receive the ball screw 61 passed therethrough. The through-hole 62A is formed on an inner circumferential surface with a helical nut-thread 62B corresponding to the thread 61A, 61B and with a helical nut thread groove 62C corresponding to the shaft thread groove 61C, 61D. A plurality of rollable balls 65 is disposed between the nut thread grooves 62C and the corresponding shaft thread grooves 61C, 61D. The rotation of the ball screw 61 allows the sliders 62 to travel on the ball screw 61 via the balls 65 in the axial direction.

The slider 62 is formed on both lateral surfaces with grooves 66 (vertical grooves) extending vertically and perpendicularly to the ball screw 61. An upper end of the groove 66 is formed as an opening portion 66A communicating with an upper surface of the slider 62. A lower end of the groove 66 is formed as a wall portion 66B not communicating with a lower surface of the slider 62.

A sensor 80 for detecting a turning amount of the ball screw 61 is provided at the other end of the ball screw 61 on the intake side. The ECU calculates a swing amount of the holder member 53 on the basis of the turning amount of the ball screw 61 detected by the sensor 80.

The sensor 80 is secured to a side wall portion of the head cover 133A (133B) located on the inside of the V-bank. Since the sensor 80 is disposed on the inside of the V-bank as described above, it is possible to reduce the length of the engine 17 in the anteroposterior direction of the vehicle body and to surround the sensor 80 by the front bank 110A and the rear bank 110B (FIG. 2).

The sensor 80 includes a turning shaft 81 provided at the other end portion of the ball screw 61; a fixed shaft 82 composed of a hexagonal screw disposed below and substantially parallel to the turning shaft 81 and secured to the lower portion of the ball screw support portion 203; a driven gear 84 rotatably supported by the fixed shaft 82; and a sensor body 85 connected to the driven gear 84 to detect a turning amount of the driven gear 84. A drive gear 83 is formed on the outer circumferential surface of the turning shaft 81 and meshes with the driven gear 84.

The ball screw 61 is turned to transmit the turning of the turning shaft 81 turning integrally with the ball screw 61 to the driven gear 84 via the drive gear 83. The turning number of the drive gear 83 is reduced by the driven gear 84. The sensor body 85 detects the turning amount of the driven gear 84. The turning amount of the ball screw 61 is determined based on the turning amount of the driven gear 84.

As illustrated in FIGS. 6 and 7, the drive mechanism connecting member 63 includes an arm member 86 connected to the slider 62; a connecting bolt 87 (connecting member) connecting the arm member 86 with the second plate 53B of the holder member 53; and a connecting nut 88 provided between the arm member 86 and the second plate 53B. Also, the slider 62 and the arm member 86 are such that identical component parts are arranged on the intake side and the exhaust side symmetrically to the axially intermediate portion of the ball screw 61. Although FIG. 7 illustrates the periphery of the drive mechanism connecting member 63 on the exhaust side, the drive mechanism connecting member 63 on the intake side is configured similarly to that on the exhaust side.

Figure 9:
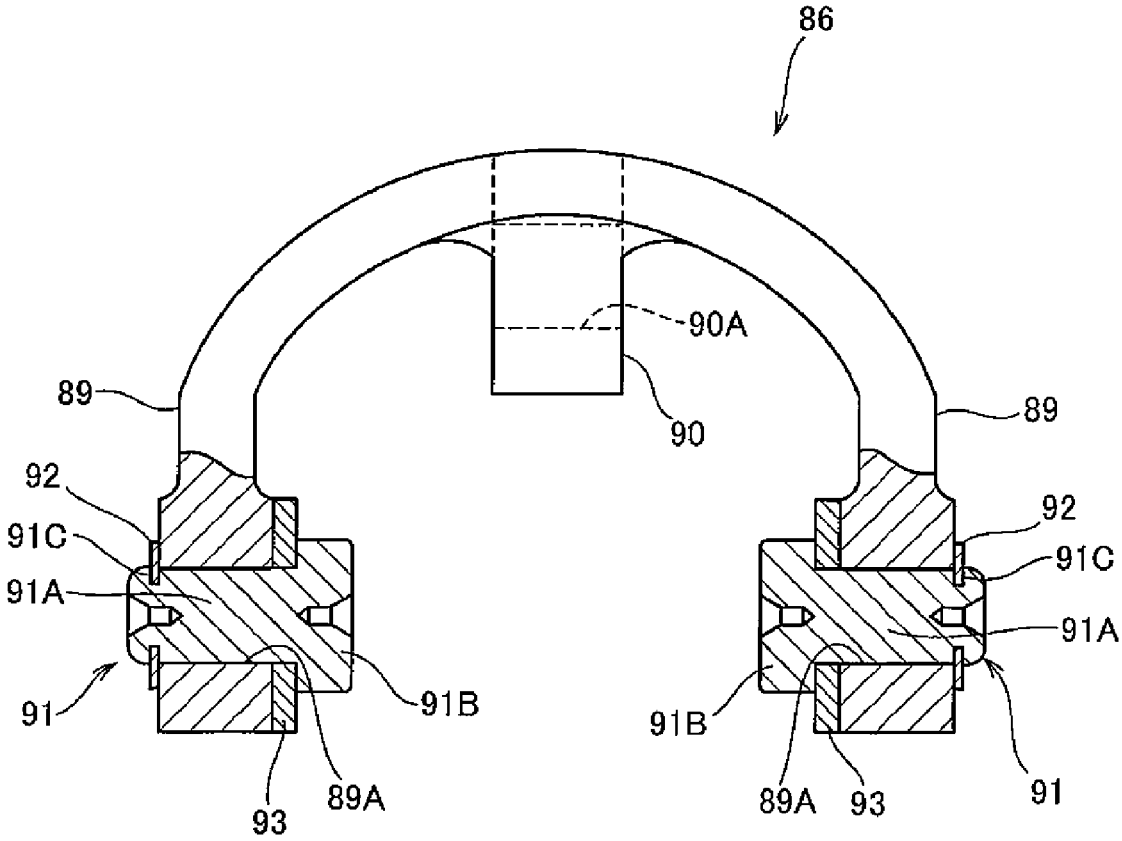
FIG. 9 is a plan view of an arm member.

FIG. 9 is a plan view of the arm member 86.

As illustrated in FIGS. 6, 8 and 9, the arm member 86 includes a pair of arms 89 extending to hold the slider 62 from both the lateral surfaces thereof; and an arm-connecting portion 90 (swing portion end) formed at the widthwise intermediate portion of the pair of arms 89 and at the proximal end portions of the arms 89.

The arms 89 are provided to face each other. The arms 89 are each formed at a distal end with a pin support hole 89A passing through the arm 89 widthwise. The pin hole support hole 89A is adapted to receive an arm connecting pin 91 inserted therethrough, the arm connecting pin 91 connecting the arm 89 with the slider 62.

The arm connecting pin 91 includes a pin portion 91A fitted to the pin support hole 89A; and a disk-like flange portion 91B formed to have a diameter greater than that of the pin support hole 89A. The pin portion 91A is formed at an end with a clip groove portion 91C going round the outer circumferential surface of the pin portion 91A. The arm connecting pin 91 is inserted through the pin support hole 89A from the inside of the pair of arms 89.

In addition, a ring-like clip 92 is engaged with the clip groove portion 91C located outside the arm 89. Thus, the arm connecting pin 89 is provided integrally with the arm member 86. The flange portion 91B is located inside the arm 89. A washer 93 is provided between the flange portion 91B and the arm 89.

The arm member 86 is connected to the slider 62 by the flange portions 91B fitted to the pair of corresponding grooves 66 on the side surface of the slider 62. Specifically, the flange portion 91B is provided in the groove 66 in a vertically slidable and turnable manner. While being supported in the grooves 66, the arm member 86 is swingable around the flange portions 91B. In other words, when the arm member 86 is swung, it swings around the flange portions 91B with the arm-connecting portion 90 being the end of the swing.

As illustrated in FIG. 6, the arm member 86 is formed in a general L-shape as viewed from the side. In addition, the arm-connecting portion 90 is formed to project perpendicularly to the arm 89 from the end opposite the pin support hole 89A. As illustrated in FIG. 7, the arm-connecting portion 90 is formed with an arm connecting hole 90A (the connecting portion) parallel to the pin support hole 89A. The arm member 86 is connected to a second plate 53B via a connecting bolt 87 inserted through the arm connecting hole 90A.

Figure 10:
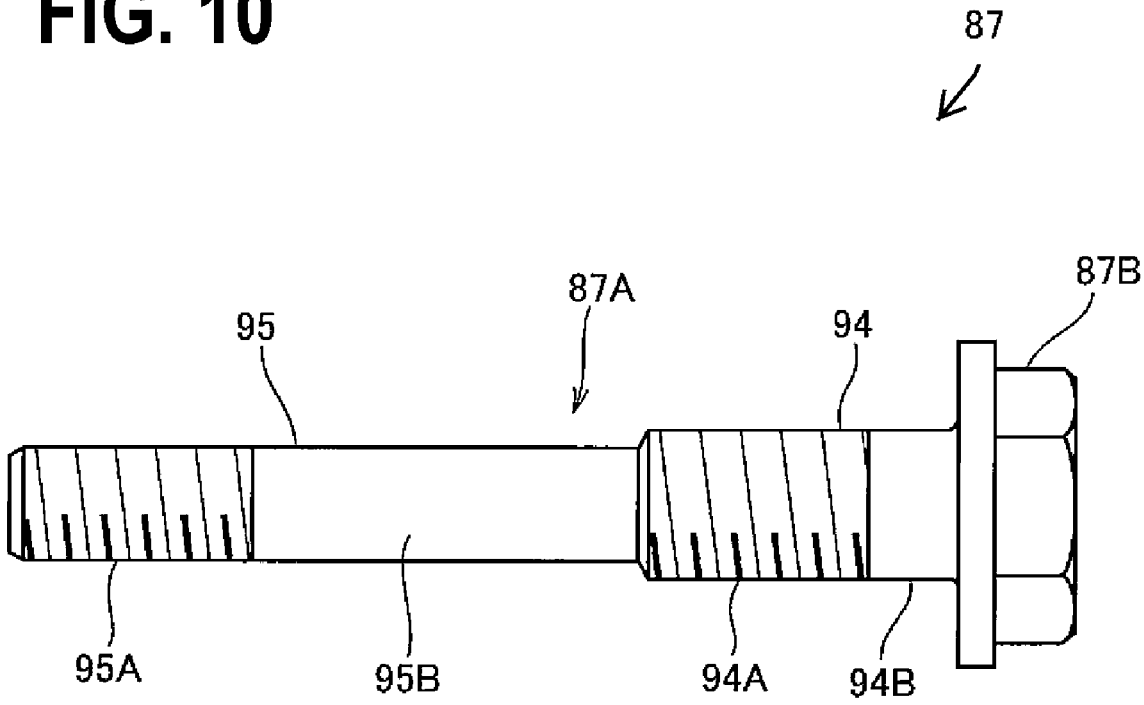
FIG. 10 is a lateral view of a connecting bolt.

FIG. 10 is a lateral view of the connecting bolt 87.

Referring to FIGS. 7 and 10, the connecting bolt 87 includes a shaft portion 87A formed with a thread portion; and a bolt head portion 87B formed at an end of the shaft portion 87A. The shaft portion 87A is a stepped shaft and has a holder side shaft portion 94 formed close to the bolt head portion 87B; and an arm side shaft portion 95 formed to have a diameter smaller than that of the holder side shaft portion 94 and to terminate at the distal end of the connecting bolt 87.

The holder side shaft portion 94 is formed with a first thread portion 94A and the arm side shaft portion 95 is formed at a distal end portion with a second thread portion 95A having a diameter smaller than that of the first thread portion 94A. The holder side shaft portion 94 has, on the proximal end side, a smooth portion 94B not formed with the first thread portion 94A. The arm side shaft portion 95 has a smooth portion 95B not formed with the second thread portion 95A, in an interval between the second thread portion 95A and the first thread portion 94A. Because of requiring greater fastening force, the first thread portion 94A secured to the holder member 53 is formed to have a diameter greater than that of the second thread portion 95A.

The connecting bolt 87 is inserted through the bolt hole 53C of the second plate 53B from the side of the sub-rocker arm holder 59, i.e., from the inside surface of the second plate 53B and extends toward the arm member 86 in general parallel to the camshaft 151. The end of the second thread portion 95A goes over the ball screw 61 and reaches the vicinity of the external side surface of the slider 62.

As illustrated in FIG. 7, the connecting bolt 87 is secured to the second plate 53B by means of the connecting nut 88 fastened to the shaft portion 87A from the external side surface side of the second plate 53B. The connecting nut 88 includes a nut side thread portion 88A and a seat portion 88B. The nut side thread portion 88A is formed like an axially extending cylinder and threadably engaged with the first thread portion 94A.

The seat portion 88B extends from the nut side thread portion 88A to the vicinity of the second thread portion 95A and of the arm connection hole 90A in the assembled state. A runout portion 88C is formed in the inner circumferential surface of the seat portion 88B so as to have a diameter greater than that of the smooth portion 95B.

A nut 96 is fastened to the second thread portion 95A of the connecting bolt 87. The arm member 86 is fastened and secured to the connecting bolt 87 in the state where the arm-connecting portion 90 is held between the nut 96 and the seat portion 88B of the connecting nut 88. In other words, the connecting nut 88 allows the arm member 86 to be fastened to the connecting bolt 87 in cooperation with the nut 96.

A flat washer 97 is provided between the nut 96 and the arm-connecting portion 90 and between the arm-connecting portion 90 and the seat portion 88B.

The second plate 53B and the arm member 86 are secured to each other via the connecting bolt 87, the connecting nut 88, the nut 96 and the like. The arm member 86 is secured to the second plate 53B while maintaining a predetermined position and angle relative thereto. If the slider 62 is shifted on the ball screw 61 by the drive mechanism 60, the arm member 86 is swung around the arm connecting pin 91 to swing the holder member 53 while the arm connecting pin 91 is vertically slid in the groove 66.

As described above, the arm member 86 is secured to the second plate 53B and the arm connecting pin 91 fitted to the groove 66 of the slider 62 is made to serve as the center of the swing of the arm member 86. Therefore, it is not necessary to provide a swingable link and the like on the second plate 53B. Thus, the second plate 53B and the slider 62 can be connected to each other with a small-sized and lightweight configuration having a small number of parts.

The nut 96 is fastened to the second thread portion 95A at one end of the connecting bolt 87 so that the arm member 86 is secured to the connecting bolt 87. The nut side tread portion 88A is fastened to the first thread portion 94A at the other end of the connecting bolt 87 so that the connecting bolt 87 is secured to the second plate 53B. The connecting bolt 87 is independently fastened to the side of the second plate 53B and to the side of the arm member 86. In this way, the arm member 86 can reliably be secured to the second plate 53B. Thus, an assembly error between the holder member 53 and the arm member 86 can be reduced. Friction occurring when the drive mechanism 60 swings the holder member 53 can be reduced and the distortion of the overall valve train 50 including the drive mechanism 60 can be reduced, thereby achieving desirable valve operating characteristics.

A description is here given of an assembly procedure for the drive mechanism connecting member 63.

As illustrated in FIG. 7, first, the connecting bolt 87 is inserted through the bolt hole 53C of the second plate 53B and the connecting nut 88 is fastened to the first thread portion 94A, whereby the connecting bolt 87 is secured to the second plate 53B. Next, the arm connecting pins 91 of the arm member 86 are fitted to the corresponding grooves 66 from the corresponding opening portions 66A of the slider 62 to thereby connect the arm member 86 to the slider 62.

Thereafter, the arm side shaft portion 95 of the connecting bolt 87 is inserted through the arm connecting hole 90A of the arm-connecting portion 90 and the nut 96 is fastened to the second thread portion 95A, whereby the arm member 86 is secured to the connecting bolt 87. In this way, the drive mechanism 60 and the holder member 53 are connected to each other via the drive mechanism connecting member 63.

In the present illustrative embodiment, when the arm member 86 is assembled to the slider 62, the arm connecting pins 91 of the arm member 86 can be fitted to the corresponding grooves 66 from the corresponding opening portions 66A of the slider 62. Thus, the arm member 86 can easily be assembled to the slider 62. In the state where the arm connecting pins 91 are fitted to corresponding the grooves 66, the arm member 86 is secured to the second plate 53B by means of the connecting bolt 87 and the like, the arm connecting pin 91 will not disengage from the opening portion 66A.

Further, when the nut 96 is fastened to the second thread portion 95A to secure the arm member 86 to the connecting bolt 87, in the state where the angle of the holder member 53 is made appropriate the attachment angle of the arm member 86 with respect to the second plate 53B and the position of the slider 62 are finely adjusted and fixed. This can accommodate the dimension accuracy and assembly error of the parts among the drive mechanism 60, the drive mechanism connecting member 63 and the holder member 53. Thus, it is possible to prevent the valve train 50 from being assembled in a distorted state.

A description is next given of a method of assembling the camshaft 151 of the valve train 50 and its peripheral parts.

The valve train 50 is assembled by installing a camshaft structure 200 configured by assembling the parts, on the camshaft support portions 201, 202 (FIG. 5) of the cylinder head 132A. The camshaft structure 200 is assembled using an assembling jig 250 (see FIG. 11).

Figure 11:
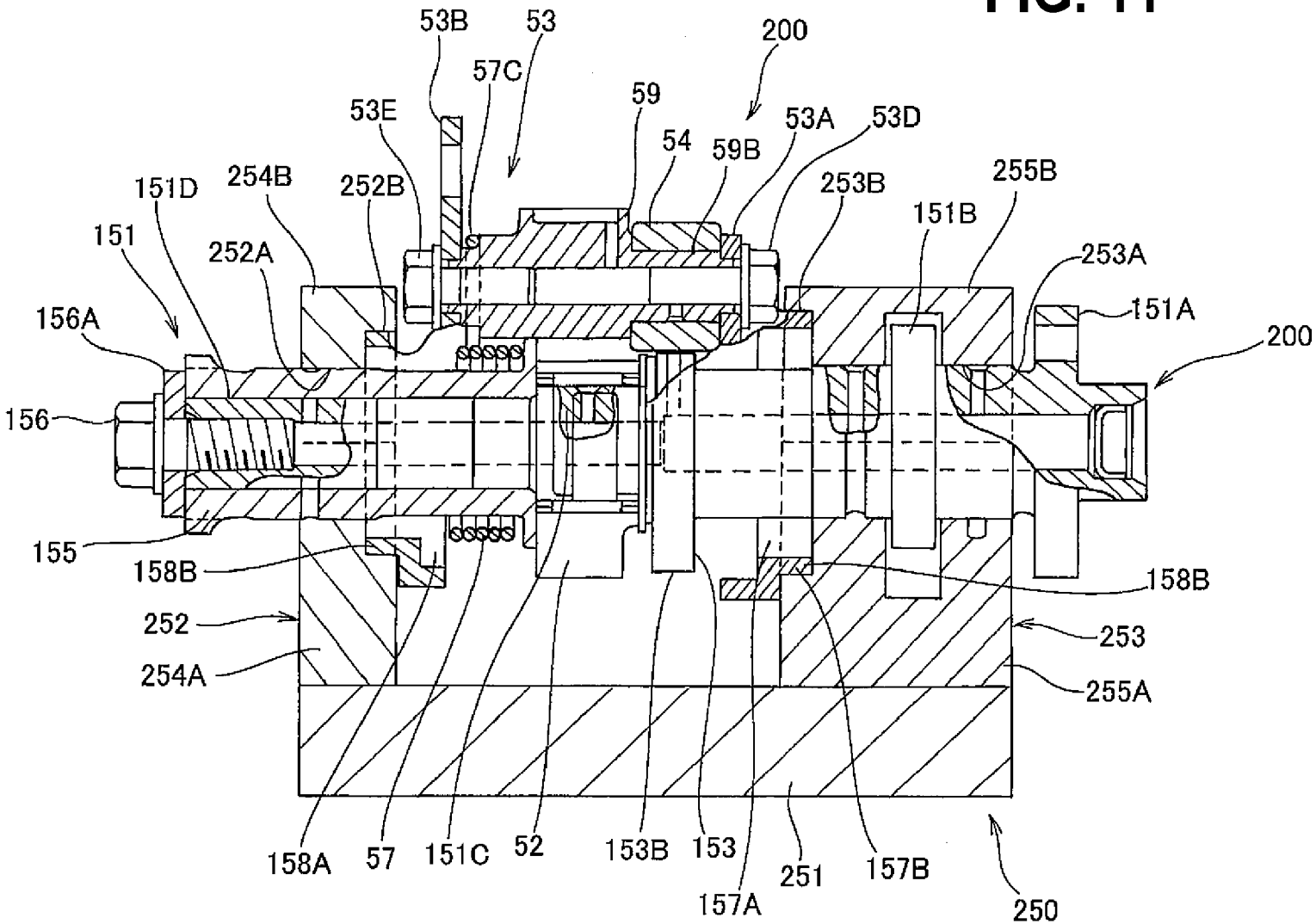
FIG. 11 is a partial broken-away cross-sectional view illustrating a camshaft structure set on an assembling jig.
Figure 12:
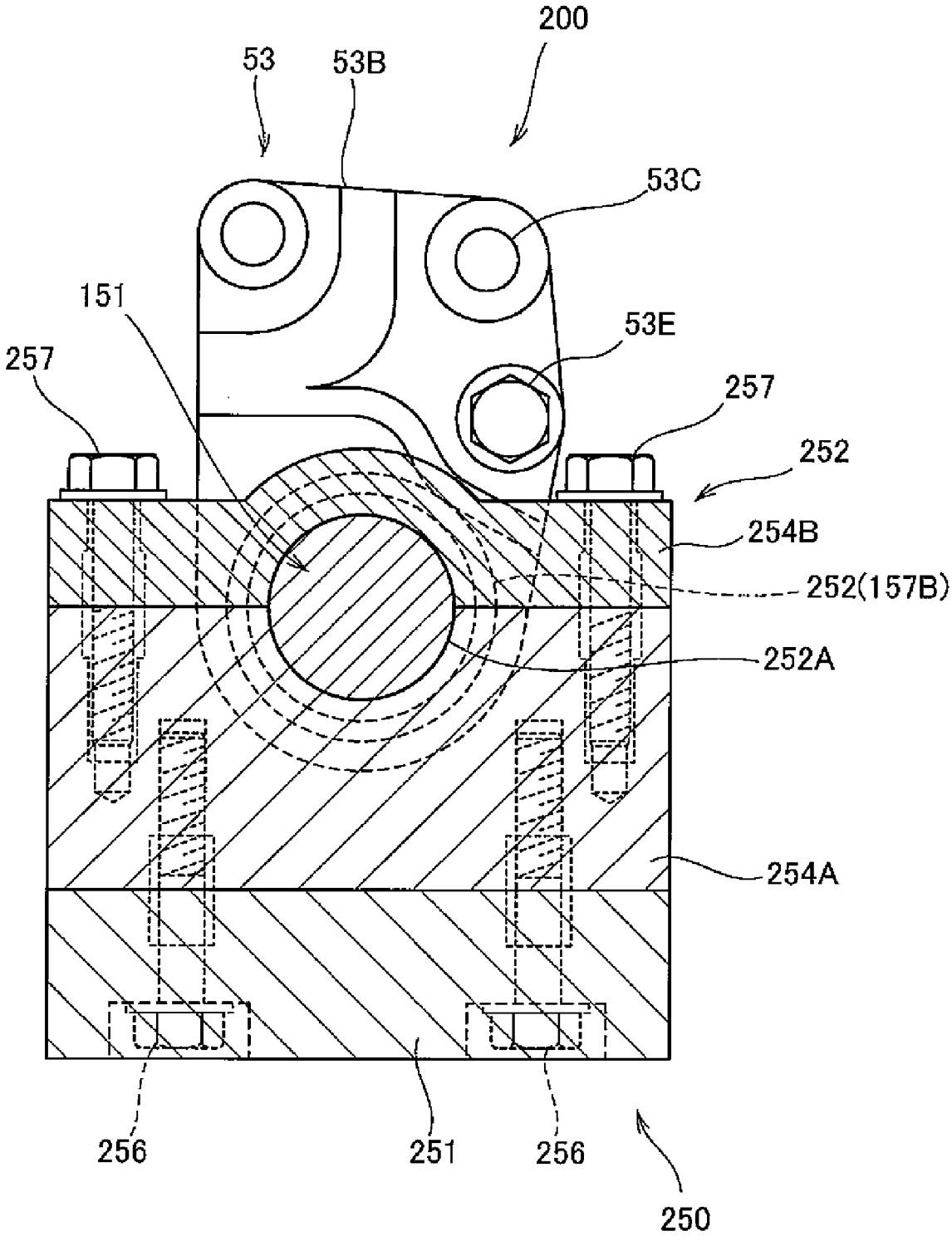
FIG. 12 is a lateral cross-sectional view illustrating the assembling jig and the camshaft structure.

FIG. 11 is a partial broken-out cross-sectional view illustrating the camshaft structure 200 set on the assembling jig 250. FIG. 12 is a lateral cross-sectional view illustrating the assembling jig 250 and the camshaft structure 200.

The assembling jig 250 is configured to include a base plate 251, and camshaft holders 252, 253 provided on the base plate 251. The camshaft holders 252, 253 are provided at both ends of the base plate 251 to support the corresponding ends of the camshaft 151. Specifically, the camshaft holders 252, 253 are provided to have respective shapes and a positional relationship corresponding to the camshaft support portions 201, 202 of the cylinder head 132A.

In addition, the camshaft holder 252, 253 are configured to be able to support the camshaft 151 in a state equivalent to the camshaft support portions 201, 202. In short, the assembling jig 250 is such that the support portions equivalent to the camshaft support portions 201, 202 are configured on the base plate 251.

The camshaft holder 252 is formed with a shaft support portion 252A rotatably supporting the camshaft 151 and with a holder support portions 252B supporting an annular projecting portion 158B of the second plate 53B. The camshaft holder 253 is formed with a shaft support portion 253A rotatably supporting the camshaft 151 and with a holder support portion 253B supporting an annular projecting portion 157B of the first plate 53A. The camshaft holders 252, 253 are each provided so as to be divided into upper and lower portions. Specifically, the camshaft holder 252 is configured by combining a lower half portion 254A forming the lower portion with an upper half portion 254B forming the upper portion.

Similarly, the camshaft holder 253 is configured by combining a lower half portion 255A forming the lower portion with an upper half portion 255B forming the upper portion. The shaft support portion 252A and the holder support portion 252B are each formed circularly by integrally assembling together the lower half portion 254A and the upper half portion 254B. Similarly, the shaft support portion 253A and the holder support portion 253B are each formed circularly by integrally assembling together the lower half portion 255A and the upper half portion 255B.

The shaft support portions 252A, 253A and the holder support portions 252B, 253B are machined with a high-degree of accuracy so that a portion supporting the camshaft 151 and a portion supporting each of the annular projecting portions 157B, 158B are coaxial with each other.

The lower half portions 254A, 255A are secured to the base plate 251 from the bottom surface side thereof by means of bolts 256. The upper half portions 254B, 255B are secured to the respective lower half portions 254A, 255A from the corresponding upper surfaces thereof by means of a plurality of bolts 257.

A description is next given of an assembly procedure of the camshaft structure 200.

The camshaft 151 is integrally formed at one end with a sprocket securing portion 151A having a large diameter. The first and second plates 53A, 53B and the valve-operating cam 52 cannot be inserted through the camshaft 151 from one end side. Therefore, the component parts of the camshaft structure 200 such as the first and second plates 53A, 53B, the valve-operating cam 52 and the like are inserted through from the front side which is the side of the collar fitting portion 151D on the other end side toward the back side where the sprocket securing portion 151A is located.

First, an integral assembly composed of the first plate 53A, the sub-rocker arm holder 59, the sub-rocker arm 54, the connecting link 55 and the valve-operating cam 52 is passed through the camshaft 151 and the valve-operating cam 52 is assembled to the valve-operating cam support portion 151C. In this state, the bolts 53D are temporarily fastened, so that the sub-rocker arm holder 59 is not secured to the first plate 53A completely.

Next, the camshaft color 155 is fitted to the color fitting portion 151D and the securing bolt 156 is fastened with a washer 156A interposed therebetween and secured to the camshaft collar 155. Thereafter, the return spring 57 is passed through the camshaft collar 155. One end 57A of the return spring 57 is inserted into the through-hole 52C and the other end 57C is hooked on the sub-rocker arm holder 59. Then, the second plate 53B is passed through the camshaft 151 and is temporarily fastened to the sub-rocker arm holder 59 by means of the bolts 53E.

The procedure, as described above, brings the camshaft structure 200 into a temporarily assembled state. In this state, the first plate 53A and the second plate 53B are not secured to the sub-rocker arm holder 59 completely and also the positions of the first and second plates 53A, 53B relative to the camshaft 151 are not fixed.

Next, the camshaft structure 200 in the temporarily assembled state is set on the assembling jig 250. Specifically, the camshaft structure 200 is disposed in such a manner that both the ends of the camshaft 151 are supported by the shaft support portions 252A, 253A and the annular projecting portions 157B, 158B are supported by the holder support portions 252B, 253B, respectively. The upper half portions 254B, 255B are secured by the bolts 257, whereby the setting of the camshaft structure 200 is completed.

As described above, the shaft support portions 252A, 253A and the holder support portions 252B, 253B are machined with a high-degree of accuracy so as to be coaxial with each other. Therefore, the camshaft structure 200 set on the assembling jig 250 is in the state where the coaxial degree between the camshaft 151 and the annular projecting portions 157B, 158B, i.e., where the axial centers of both generally coincide with each other. In this state, the bolts 53D and the bolts 53E are completely fastened, whereby the camshaft structure 200 can be assembled in the state where the coaxial degree between the camshaft 151 and the annular projecting portions 157B, 158B is high.

As described above, the high coaxial degree can be obtained only by setting the camshaft structure by use of the assembling jig 250; therefore, the assembly performance of the valve train 50 can be improved.

The coaxial degree between the first plate 53A and the second plate 53B and between the first and second plates 53A, 53B and the camshaft 151 can be improved. Therefore, friction occurring when the drive mechanism 60 can swing the holder member 53 can be reduced and the distortion of the entire valve train 50 including the drive mechanism 60 can be reduced to achieve desired valve operating characteristics. Further, friction on the periphery of the drive mechanism 60 can be reduced; therefore, the load of the electric actuator 70 can be reduced and fuel consumption can be improved.

If the assembling jig 250 is not used, the camshaft structure 200 in the temporarily assembled state may be set on the camshaft support portions 201, 202 of the cylinder head 132A and in this set state, the bolts 53D and the bolts 53E may completely be fastened.

As described above, according to the embodiment of the present invention, the arm member 86 is swingably attached to the grooves 66 of the slider 62 via the arm connecting pins 91 and the arm-connecting portion 90 of the arm member 86 and the holder member 53 are secured to each other by means of the connecting bolt 87. Therefore, the slider 62 and the holder member 53 can be connected to each other with a small-sized and lightweight configuration. Thus, the holder member 53 and the drive mechanism 60 can be connected to each other with a configuration simplified and having a small number of parts.

The connecting bolt 87 has the first thread portion 94A and the second thread portion 95A. The connecting nut 88 and the first thread portion 94A are fastened to each other on the side of the holder member 53. The nut 97 and the second thread portion 95A are fastened to each other on the side of the arm member 86. The connecting bolt 87 is fastened separately on the side of the holder member 53 and on the side of the arm member 86. Therefore, the holder member 53 and the arm member 86 can reliably be secured to each other. Thus, the assembling error between the holder member 53 and the arm member 86 can be reduced.

The second thread portion 95A, on the side of the holder member 53, requiring greater fastening force is made to have a greater diameter. In addition, the first thread portion 94A requiring only smaller fastening force is made to have a diameter smaller than that of the second thread portion 95A. Accordingly, it is possible to make the fastening force appropriate, thereby reducing an assembling error.

Further, the connecting nut 88 fastening the first thread portion 94A is extended to the vicinity of the arm connecting hole 90A of the arm member 86. The nut 96 fastened to the second thread portion 95A and the seat portion 88B resulting from the extension of the connection nut 88 cooperatively fastens the arm member 86 to the connecting bolt 87. Therefore, it is not necessary to use a spacer or the like receiving the nut 96 fastening the second thread portion 95A, thereby reducing the number of component parts.

Further, the arm connecting pin 91 of the arm member 86 can be attached to the vertically extending grooves 66 of the slider 62 from the corresponding opening portions 66A of the grooves 66. Therefore, the arm member 86 can easily be assembled to the slider 62.

Incidentally, the embodiment described above represents one aspect embodying the present invention. The present invention is not limited to the embodiment described above.

In the illustrative embodiment described above, the connecting bolt 87 is described as being inserted through the bolt hole 53C from the inside surface of the second plate 53B. However, the present invention is not limited to this. For example, a connecting bolt is disposed in a direction reverse to that of the connecting bolt 87. This connecting bolt is inserted through the arm connecting hole 90A from the side of the arm 89 and secured to the arm 89 with a connecting bolt. The distal end of the connecting bolt may be fastened to the bolt hole 53C of the second plate 53B with a nut. The other detail configurations can arbitrarily be modified.

In other words, although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A variable valve train for an internal combustion engine, said valve train comprising:

a camshaft rotatably supported by a cylinder head of the engine, and operable to rotate in synchronization with rotation of a crankshaft of the engine;

a drive cam operable to rotate integrally with the camshaft;

a valve-operating cam swingably supported by the camshaft, and operable to perform opening/closing of an engine valve;

a link mechanism supported swingably around the camshaft, and operable to transmit valve drive force of the drive cam to the valve-operating cam for swinging thereof, said link mechanism comprising a support member;

a holder member having the support member of the link mechanism is arranged thereon, said holder member being operable to turn around the camshaft; and a drive mechanism operable to turn the holder member for varying a position of the support member of the link mechanism;

wherein the drive mechanism comprises a ball screw provided perpendicularly to the camshaft, a slider threadably engaged with the ball screw, an arm member swingably attached to the slider, said arm member having a swing portion end; and a connecting member having one end thereof secured to the swing portion end of the arm member, and the other end thereof secured to the holder member; and wherein said link mechanism is configured such that operating characteristics of the opening/closing engine valve are varied according to a swung position of the link mechanism.

2. The variable valve train for an internal combustion engine according to claim 1, wherein said arm member of the drive mechanism comprises a connecting portion; and wherein the connecting member of the drive mechanism comprises a first thread portion fastened to the holder member side, and a second thread portion secured to the connecting portion of the arm member.

3. The variable valve train for an internal combustion engine according to claim 2, wherein the slider comprises an attachment portion having a vertical groove formed therein, and wherein said arm member is assembled with the slider via said vertical groove.

4. The variable valve train for an internal combustion engine according to claim 2, wherein the first thread portion has a thread diameter less than a thread diameter of the second thread portion.

5. The variable valve train for an internal combustion engine according to claim 4, wherein a nut fastening of the first thread portion is configured such that the other end thereof is extended to the connecting portion of the arm member, and wherein said nut fastening of the first thread portion is used to fasten the arm member to the connecting member in cooperation with a nut fastening of the second thread portion.

6. The variable valve train for an internal combustion engine according to claim 4, wherein the slider comprises an attachment portion having a vertical groove formed therein, and wherein said arm member is assembled with the slider via said vertical groove.

7. The variable valve train for an internal combustion engine according to claim 2, wherein a nut fastening of the first thread portion is configured such that the other end thereof is extended to the connecting portion of the arm member, and wherein said nut fastening of the first thread portion is used to fasten the arm member to the connecting member in cooperation with a nut fastening of the second thread portion.

8. The variable valve train for an internal combustion engine according to claim 7, wherein the slider comprises an attachment portion having a vertical groove formed therein, and wherein said arm member is assembled with the slider via said vertical groove.

9. The variable valve train for an internal combustion engine according to claim 1, wherein the slider comprises an attachment portion having a vertical groove formed therein, and wherein said arm member is assembled with the slider via said vertical groove.

10. A V-type internal combustion engine, comprising:

a crankshaft;

a camshaft rotatably supported by a cylinder head of the engine, and operable to rotate in synchronization with the said crankshaft;

a drive cam operable to rotate integrally with the camshaft;

a valve-operating cam swingably supported by the camshaft, and operable to perform opening/closing of an engine valve;

a link mechanism supported swingably around the camshaft, and operable to transmit valve drive force of the drive cam to the valve-operating cam for swinging thereof, said link mechanism comprising a support member;

a holder member having the support member of the link mechanism is arranged thereon, said holder member being operable to turn around the camshaft; and a drive mechanism operable to turn the holder member for varying a position of the support member of the link mechanism;

wherein the drive mechanism comprises a ball screw provided perpendicularly to the camshaft, a slider threadably engaged with the ball screw, an arm member swingably attached to the slider, said arm member having a swing portion end; and a connecting member having one end thereof secured to the swing portion end of the arm member, and the other end thereof secured to the holder member.

11. A V-type internal combustion engine according to claim 10, wherein said arm member of the drive mechanism comprises a connecting portion; and wherein the connecting member of the drive mechanism comprises a first thread portion fastened to the holder member side, and a second thread portion secured to the connecting portion of the arm member.

12. A V-type internal combustion engine according to claim 11, wherein the first thread portion has a thread diameter less than a thread diameter of the second thread portion.

13. A V-type internal combustion engine according to claim 11, wherein a fastening of the first thread portion is configured such that the other end thereof is extended to the connecting portion of the arm member, and wherein said fastening of the first thread portion is used to fasten the arm member to the connecting member in cooperation with a fastening of the second thread portion.

14. A V-type internal combustion engine according to claim 11, wherein the slider comprises an attachment portion having a vertical groove formed therein, and wherein said arm member is assembled with the slider via said vertical groove.

15. A V-type internal combustion engine according to claim 10, wherein the slider comprises an attachment portion having a vertical groove formed therein, and wherein said arm member is assembled with the slider via said vertical groove.

16. In a motorcycle comprising a V-type internal combustion engine having a crankshaft, a variable valve train comprising a camshaft rotatably supported by a cylinder head of the engine, and operable to rotate in synchronization with the said crankshaft;

a drive cam operable to rotate integrally with the camshaft;

a valve-operating cam swingably supported by the camshaft, and operable to perform opening/closing of an engine valve;

a link mechanism supported swingably around the camshaft, and operable to transmit valve drive force of the drive cam to the valve-operating cam for swinging thereof, said link mechanism comprising a support member;

a holder member having the support member of the link mechanism is arranged thereon, said holder member being operable to turn around the camshaft; and a drive mechanism operable to turn the holder member for varying a position of the support member of the link mechanism;

wherein the drive mechanism comprises a ball screw provided perpendicularly to the camshaft, a slider threadably engaged with the ball screw, an arm member swingably attached to the slider, said arm member having a swing portion end; and a connecting member having one end thereof secured to the swing portion end of the arm member, and the other end thereof secured to the holder member.

17. A variable valve train according to claim 16, wherein said arm member of the drive mechanism comprises a connecting portion; and wherein the connecting member of the drive mechanism comprises a first thread portion fastened to the holder member side, and a second thread portion secured to the connecting portion of the arm member.

18. A variable valve train according to claim 17, wherein the first thread portion has a thread diameter less than a thread diameter of the second thread portion.

19. A variable valve train according to claim 17, wherein a fastening of the first thread portion is configured such that the other end thereof is extended to the connecting portion of the arm member, and wherein said fastening of the first thread portion is used to fasten the arm member to the connecting member in cooperation with a fastening of the second thread portion.

20. A variable valve train according to claim 16, wherein the slider comprises an attachment portion having a vertical groove formed therein, and wherein said arm member is assembled with the slider via said vertical groove.

* * * * *